US006601714B2

(12) United States Patent
Bladek

(10) Patent No.: US 6,601,714 B2
(45) Date of Patent: Aug. 5, 2003

(54) HAIR CLIP TREE STAND WITH STORAGE COMPARTMENT

(76) Inventor: Richard Fred Bladek, 174 S. Orange Ave., Apartment B2, South Orange, NJ (US) 07079

( * ) Notice: Subject to any disclaimer, the term of this patent is extended or adjusted under 35 U.S.C. 154(b) by 0 days.

(21) Appl. No.: 09/878,734

(22) Filed: Jun. 11, 2001

(65) Prior Publication Data

US 2002/0185460 A1 Dec. 12, 2002

(51) Int. Cl.[7] ..... A47F 7/02
(52) U.S. Cl. ..... 211/85.2; D28/73; 206/6.1
(58) Field of Search ..... 211/85.2, 59.1, 211/85.3; 206/6.1, 457, 807; D9/330; D28/73; D6/436

(56) References Cited

U.S. PATENT DOCUMENTS

| | | | | | |
|---|---|---|---|---|---|
| 444,328 | A | * | 1/1891 | Boss | 211/59.1 |
| 1,127,319 | A | * | 2/1915 | Thompson | 211/49.1 |
| 1,190,152 | A | * | 7/1916 | Gross | 211/59.1 |
| 1,690,394 | A | * | 11/1928 | Belt | 211/49.1 X |
| 1,924,955 | A | * | 8/1933 | Neifert | 211/163 |
| 2,626,062 | A | * | 1/1953 | Manzella | 211/59.1 |
| 3,420,468 | A | * | 1/1969 | Rhoades | 242/134 |
| 3,759,377 | A | * | 9/1973 | Weimer | 206/65 R |
| 4,282,976 | A | * | 8/1981 | Fitzgerald | 211/59.1 |
| 4,351,458 | A | * | 9/1982 | Wolfe | 223/106 |
| 5,762,184 | A | * | 6/1998 | Greiner | 206/6.1 |
| 5,848,710 | A | * | 12/1998 | Pomper | 211/85.2 |
| 5,996,819 | A | * | 12/1999 | Klein | 211/185.14 |
| 6,158,578 | A | * | 12/2000 | Greiner | 206/6.1 |
| D437,711 | S | * | 2/2001 | Berg | D6/436 |

* cited by examiner

*Primary Examiner*—Daniel P. Stodola
*Assistant Examiner*—Khoa Tran

(57) ABSTRACT

A decorative storage unit to display, organize and store various types of hair clips and hair accessories. The unit includes a main body that functions as a storage compartment, a lid to conceal the contents in the storage compartment, a large dowel member fastened to the center of the lid with four additional small dowel members set to the corners of the lid top. The lid is easily removed, revealing the contents inside the main body of the structure and the lid also acts as the base structure for the dowels.

4 Claims, 1 Drawing Sheet

HAIR CLIP TREE STAND WITH STORAGE COMPARTMENT

FIELD OF THE INVENTION

The present invention relates generally to cosmetic products and containers for goods.

BACKGROUND OF THE INVENTION

Many hair accessories like bobby pins, barrettes, small hair clips, and small combs are easily misplaced, damaged or have simply vanished from sight. These hair accessories are often stored in a drawer or on a closet shelf and become easily hidden, items become disorganized.

SUMMARY

The invention provides a place to organize and/or store hair clips and hair accessories. The invention also provides a viewable and decorative stand and compartment area for hair clips and hair accessories. The invention further provides a simple attachment method that allows small children to be able to fasten clips and hair accessories to the apparatus. The invention provides a storage device that has a minimum number of discrete parts and is inexpensive to manufacture. In addition, the device is durable and highly reliable.

DETAILED DESCRIPTION

Figure 1:
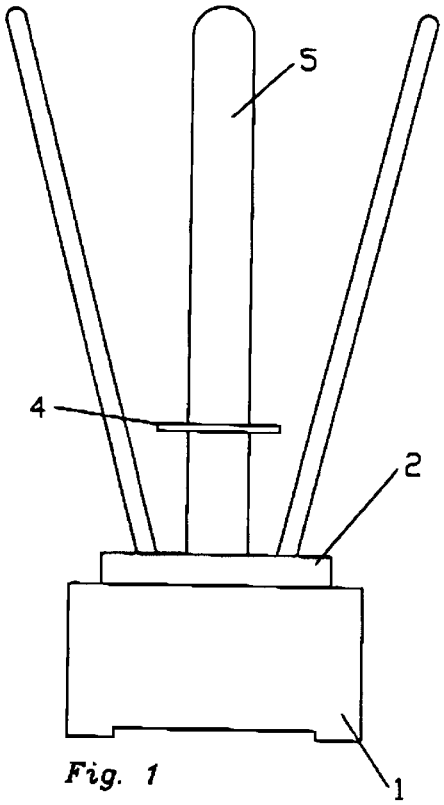
FIG. 1 is an assembled side view of a hair clip tree stand with a storage compartment in accordance with the present invention.

FIG. 1 shows an assembled side view of a hair clip tree stand including a multiple-sided base 1, a lid 2 and a storage compartment 10. Four small dowels 6, 7, 8 and 9 simulate tree branches assembled to and moving up and outward from a base of a tree, which in the figure is lid 2. The small dowels 6, 7, 8 and 9 are spaced around a large center dowel 5 assembled to the lid 2. A stop disc 4 is located on the center dowel 4, and the base 1 provides a lid 2 for a storage compartment 10 located in base 1.

Figure 3:
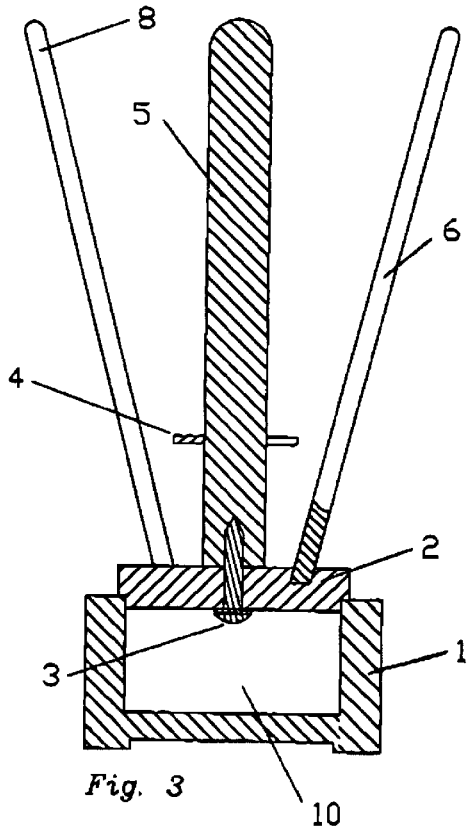
FIG. 3 is a view taken along line 3—3 of FIG. 2.
Figure 2:
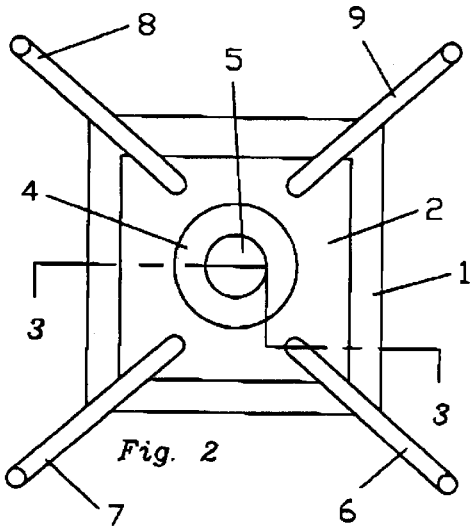
FIG. 2 is an assembled top plan view of a hair clip tree stand with a storage compartment in accordance with the present invention.

FIGS. 2 and 3 respectively show a top plan view and a sectional view of the hair clip tree stand with a storage compartment. The base 1 is used to support the simulated tree branches 6, 7, 8, and 9, and the large center dowel 5 with stop disc 4 when the lid 2 is secured in the base 1 to cover the compartment 10. The center dowel 5 with stop disc 4 can be held securely in place with a fastener 3. The four small dowels 6, 7, 8, and 9 can be attached to the lid 2 by friction fit and/or an adhesive. The stop disc 4 can be held in position by friction and/or an adhesive. The fastener 3 can be inserted through the lid 2 and the large center dowel 5.

The device helps to gather hair accessories in one location. This will help to avoid clutter and maintain organization. The invention is intended to restore order to all person(s) who own numerous types and quantities of hair clips and hair accessories. The invention has an attractive design so that it can be displayed on a bedroom dresser and compact enough to be put on a shelf in a linen closet.

The device is beneficial to all person(s) who own hairclips, scrunchies, and/or ponytail holders or bands. The top portion is designed resembling a tree with branches with five dowels to hold braided elastic bands, jaw clips, hair clips, scrunchies and ponytail bands while the base operates as a storage compartment to hold other hair accessories like bobby pins, barrettes, contour clips, hinge bars, hair hooks, hair pins, small hair clips, small combs, small side combs and pinch clips. These items would no longer need to be stored in a drawer; therefore, more drawer space would become available. These hair accessories will now be viewable, accessible, and easy to find in one location. The present invention combines an organized place to display hair clips, and it also acts as a decorative storage place to store small hair accessories that can be otherwise easily misplaced.

The removable lid 2 serves a dual purpose in that it covers the contents of the main body and compartment 10 and to serve as a base for the five dowel members attached thereto. The base and lid can be made from a variety of materials including hard-pressed wood, and the other components can be made from various materials such as metal, molded plastic, high-impact plastic. The various components and the based can be finished in either a natural state or alternatively, finished in various colors and designs, such as by painting the various components a unitary color or multiple colors.

It will be apparent to those skilled in the art that various modifications and variations can be made to the present invention without departing from the spirit or scope of the invention. Thus, it is intended that the present invention cover modifications and variations of this invention provided they come within the scope of the appended claims and their equivalents.

What is claimed is:

1. A hair accessory organization device comprising:

a hollow base portion providing a storage compartment adapted for storage of hair accessories;

a lid seated on the base and adapted to cover the storage compartment;

a central dowel member secured to and extending from a central portion of the lid adapted to hold hair accessories, the central dowel member secured to the lid so that the central dowel and the lid are simultaneously removable from the base portion to provide access to the storage compartment; and a plurality of peripheral dowel members surrounding the central dowel member secured to and extending from the lid adapted to hold hair accessories.

2. The device of claim 1, wherein the device includes at least four peripheral dowel members.

3. The device of claim 1, further including a stop disc assembled to the central dowel.

4. The device of claim 1, wherein the hollow base portion includes multiple sides.

* * * * *